US005199570A

United States Patent [19]

McKenzie

[11] Patent Number: 5,199,570

[45] Date of Patent: Apr. 6, 1993

[54] LIQUID TRANSPORTATION CONTAINER

[75] Inventor: Kenneth M. McKenzie, Winnipeg, Canada

[73] Assignee: Bonar Inc., Winnipeg, Canada

[21] Appl. No.: 801,363

[22] Filed: Dec. 2, 1991

[51] Int. Cl.[5] ..... B65D 5/00

[52] U.S. Cl. ..... 206/503; 220/4.05; 220/724; 220/649; 206/509

[58] Field of Search ..... 220/94 R, 724, 649, 220/4.05, 4.13, 503; 206/503, 508, 509, 507

[56] References Cited

U.S. PATENT DOCUMENTS

| | | | |
|---|---|---|---|
| 3,214,052 | 10/1965 | Dike | 206/509 X |
| 4,203,526 | 5/1980 | Stoll, III | 220/724 X |
| 4,385,709 | 5/1983 | Ames | 220/649 |
| 4,489,847 | 12/1984 | Ames | 220/649 |
| 4,500,007 | 2/1985 | Stoll, III | 220/4.05 X |
| 4,605,126 | 8/1986 | Goedken et al. | 220/724 X |
| 4,690,299 | 9/1987 | Cannon | 220/649 X |
| 4,768,673 | 9/1988 | Przytulla | 220/649 |
| 4,893,861 | 1/1990 | Stoltzman | 220/649 X |
| 5,014,873 | 5/1991 | Clemens | 220/4.05 X |
| 5,071,028 | 12/1991 | Murphy | 220/4.05 X |

*Primary Examiner*—Steven M. Pollard

*Attorney, Agent, or Firm*—Adrian D. Battison; Stanley G. Ade; Murray E. Thrift

[57] ABSTRACT

A liquid transportation container is substantially rectangular in shape and includes a rectangular container body and an upper flange portion in the form of a sleeve which attaches to the upper edge of the container body. The upper flange portion is separate and is attached by engagement between two shoulders defined around the upper portion of the container body and held in place by a strap wrapped around the upper flange portion. The top wall of the container has two openings one of which is arranged at a height above the other thus forming an inclined wall extending downwardly from one opening adjacent one side wall toward the second opening adjacent an opposed side wall. The second opening is retained within a recess. The first opening is arranged immediately adjacent the side wall to allow complete draining when the container is inverted. The bottom wall has an incline matching that of the top wall but reversed through 180 degrees so the liquid drains to a position directly underneath the first opening allowing complete extraction by a dip tube. A recess adjacent the opposed side wall in the bottom wall can receive the closure member in the first opening of a similar container stacked underneath the first container.

12 Claims, 7 Drawing Sheets

LIQUID TRANSPORTATION CONTAINER

FIELD OF THE INVENTION

This invention relates to a liquid transportation container.

BACKGROUND OF THE INVENTION

Many designs of liquid transportation container have previously been provided and one example is shown in Canadian Registered Design No. 68690 registered Jun. 11, 1991 which corresponds to United States Design patent application Ser. No. 704,624 filed May 23, 1991. This container is generally rectangular including upstanding side walls, a generally horizontal base wall and a generally horizontal top wall. A discharge opening is provided in the top wall adjacent one side. Around the top wall there is provided an upstanding flange member with side handles and portions of the flange member omitted adjacent the opening and at a position opposite the opening. The base is arranged so that a second similar container can be rotated through a 180 degrees about a central vertical axis and then can be stacked on top of the first container with the base within the flange member and with a recess provided to accommodate a closure member applied to the opening after filling.

SUMMARY OF THE INVENTION

It is one object of the present invention to provide a container which has a number improved features relative to the above container.

According to a first aspect of the present invention there is provided a liquid transportation container comprising a moulded hollow substantially closed container body having a generally horizontal base wall, upstanding side wall means and a generally horizontal top wall, first opening means in the top wall for discharge of liquid contents from the container, the first opening means being arranged in the top wall at a position adjacent one portion of the side wall means and remote from an opposed portion of the side wall means, the base wall being inclined relative to the horizontal such that a first location on the base wall directly vertically below the opposed portion of the side wall means is raised above a second location on the base on the base wall directly vertically below the first opening means so as to cause liquid at the base wall to run down to and collect at the second location, the top wall being inclined relative to the horizontal such that the first opening is raised above a second location on the top of wall adjacent said opposed portion of the side wall means, whereby a second similar container can be stacked underneath the container when rotated about a vertical central axis through 180 degrees.

According to a second aspect of the present invention there is provided a liquid transportation container comprising a moulded hollow substantially closed container body having a generally horizontal base wall, upstanding side wall means and a generally horizontal top wall, first opening means in the top wall for discharge of liquid contents from the container wherein the first opening means comprises a substantially cylindrical wall having a substantially vertical longitudinal axis and a female screw thread on the inside surface of the wall for receiving a male threaded closure member in engagement with the female screw thread, the cylindrical wall being arranged immediately adjacent one portion of the side wall means such that an outside surface of the cylindrical wall at said one portion constitutes an outside surface of the side wall means.

According to a third aspect of the present invention there is provided a liquid transportation container comprising a moulded hollow substantially closed container body having a generally horizontal base wall, upstanding side wall and a generally horizontal top wall wherein there is provided an upper flange member attached to the container body so as to extend upwardly from the side wall means to a height above the top wall, the upper flange member extending around the full periphery of the container body and including means therein defining handle holes by which the flange member can be grasped for lifting of the container body, the upper flange member including a depending flange portion surrounding and lying in contact with an upper portion of the side wall means, the upper portion including outwardly projecting shoulder means for abutting the depending flange portion and locating the depending flange portion against vertical movement relative to the upper portion and securing band means wrapped around the depending flange portion to clamp the depending flange portion onto the upper portion of the side wall means.

One embodiment of the present invention will now be described in conjunction with the accompanying drawings, in which:

BRIEF DESCRIPTION OF THE DRAWINGS

In the drawings like characters of reference indicate corresponding parts in the different figures.

DETAILED DESCRIPTION

Figure 7:
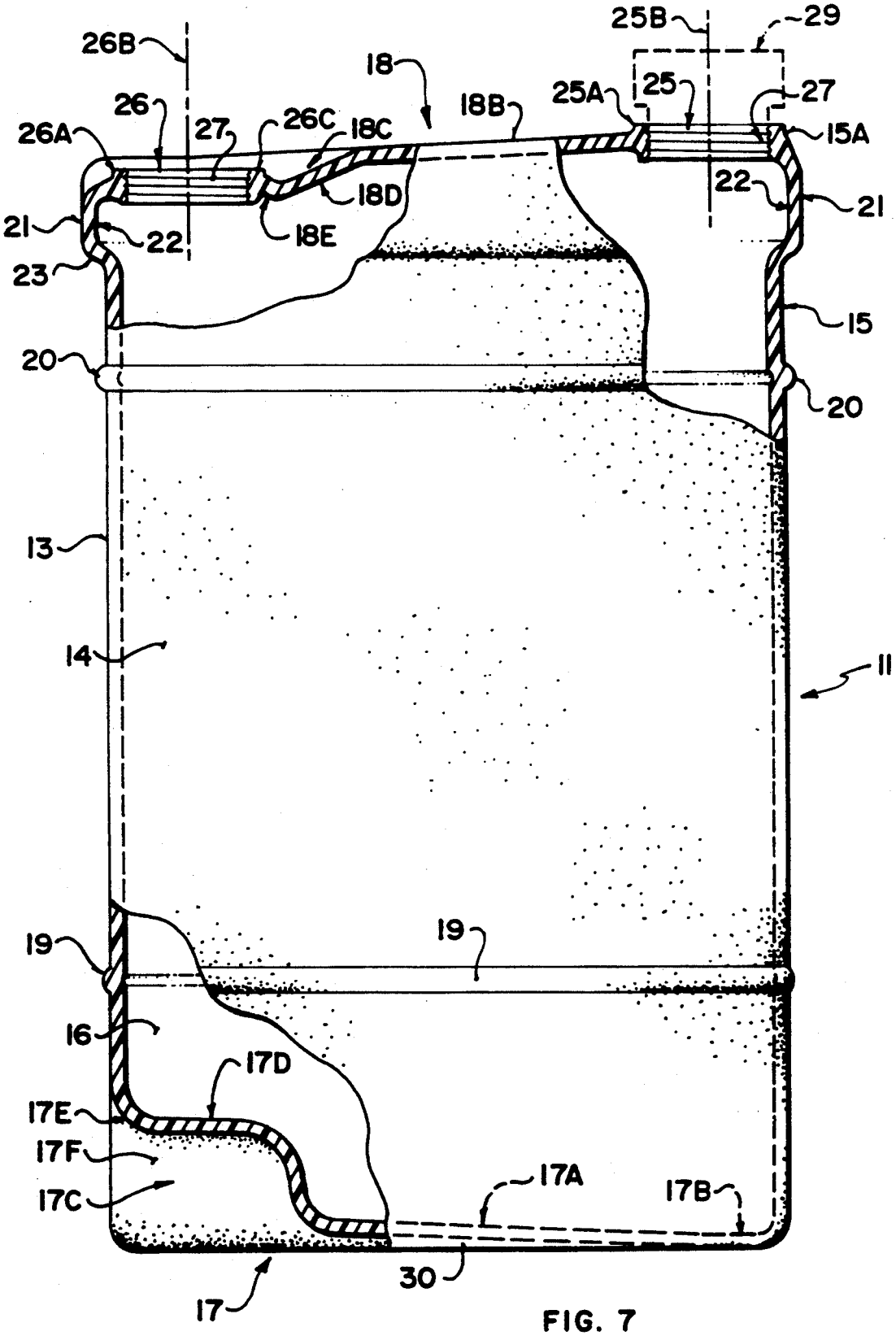
FIG. 7 is a side elevational view partly in cross section of the container in FIG. 1 with the upper flange sleeve omitted for convenience of illustration.
Figure 8:
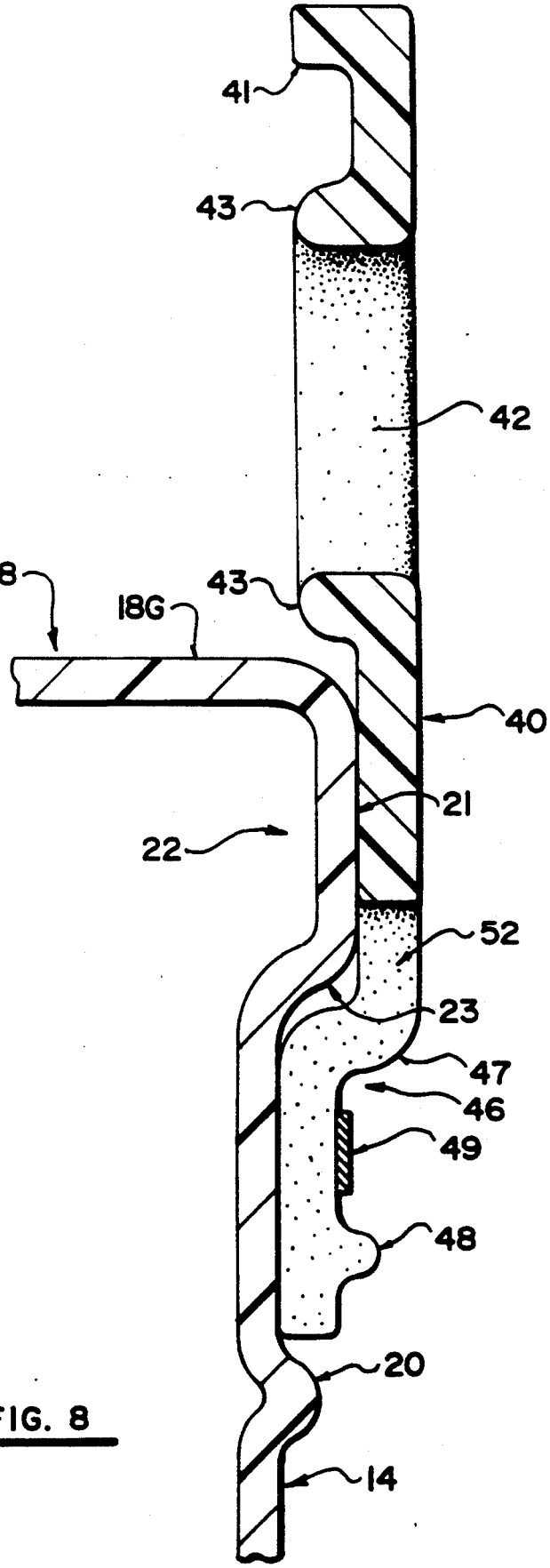
FIG. 8 is a cross sectional view along the lines 8—8 of FIG. 1 on an enlarged scale showing the cooperation between the upper flange sleeve and the upper portion of the container body.

A container is generally indicated at 10 and includes a container body 11 and a separate upper flange sleeve 12 which is attached to the container body as described hereinafter. The complete container is shown in FIGS. 1 through 6. The interconnection between the upper part of the container body and the upper flange sleeve is shown in FIG. 8. The container body itself with the upper flange sleeve removed is shown in FIG. 7.

The container body comprises a generally rectangular hollow moulded body having four upstanding side walls indicated respectively at 13, 14, 15 and 16. The container body further includes generally horizontal base wall 17 and a generally horizontal top wall 18 connecting the side walls to form the integral closed container body.

The side walls are substantially identical and extend upwardly from the base as a vertical plane panel except for the provision of two transverse stiffening ribs 19 and 20 and an uppermost transverse band 21. The band 21 connects the upper part of the side wall to the top wall 18. The band 21 projects outwardly from the main part of the side wall sufficiently to define a recess 22 on the inside of the container and to form a shoulder 23 on the underside of the band 21 with the shoulder being slightly greater in height than the thickness of the wall. The ribs 19 and 20 are simply formed as a thickening of the wall with little or no recess on the inside surface of the wall.

The top wall 18 includes a first opening 25 and a second opening 26. Each of the openings comprises a substantially cylindrical wall portion 25A, 26A with a longitudinal axis 25B, 26B which extends vertically. A female screw thread 27 is formed on the inside surface of the cylindrical wall portion for cooperation with a closure member 29 which has a male screw threaded portion for fastening into the female screw thread of the opening.

As best shown in FIG. 7, the cylindrical wall portion 25A projects upwardly and downwardly from the top wall 18 around the majority of its periphery and intersects with the side wall 15 at the connection between the top wall 18 and the side wall 15. Thus the opening 25 is arranged immediately adjacent the side wall 15. Also as indicated at 15A, one portion of the side wall 15 defines the thickness of the cylindrical wall portion 25A so the screw thread 27 is formed on the inside surface of that portion 15A and the outside wall of the portion 15A defines the outside surface which is substantially vertical of the side wall 15.

Figure 1:
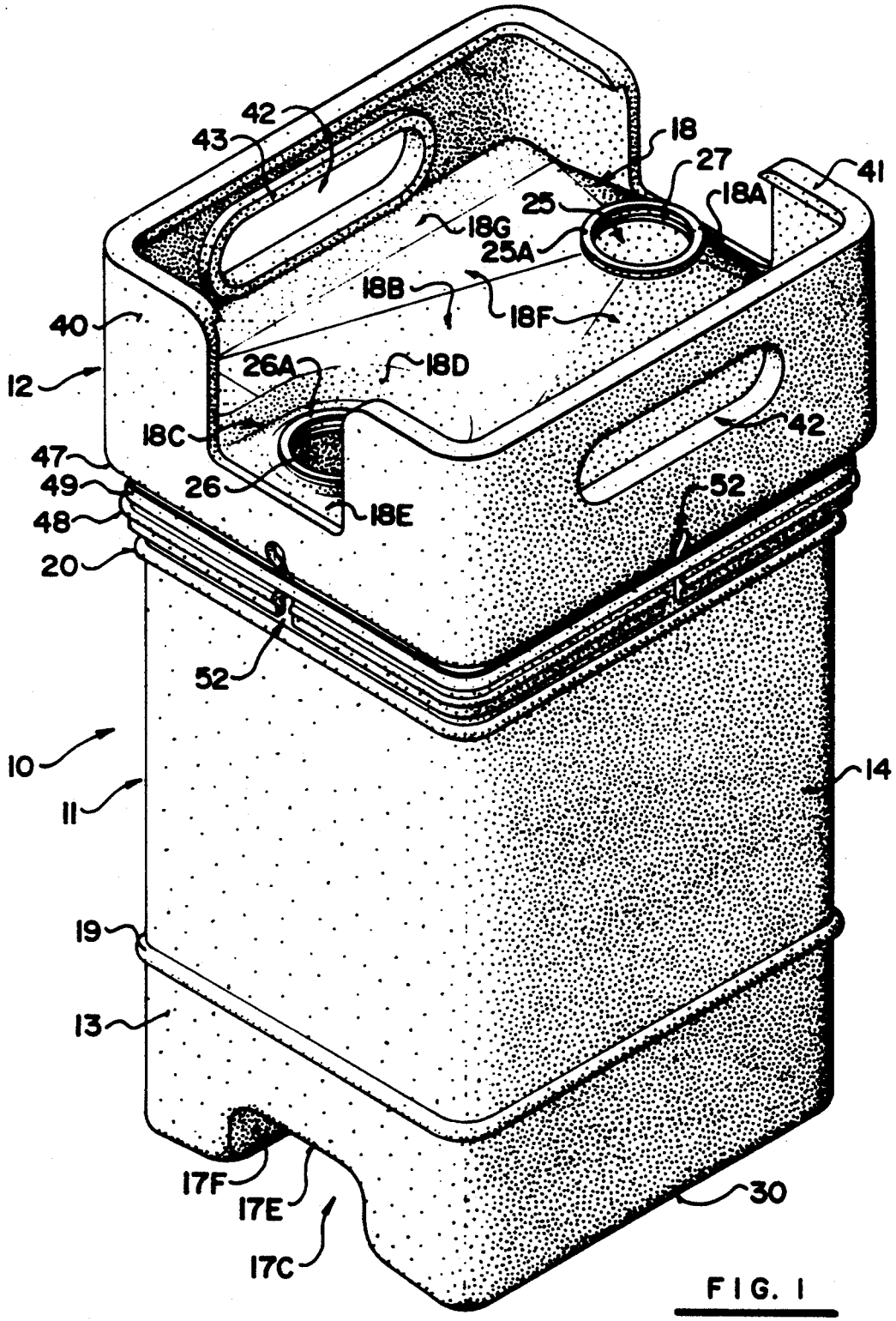
FIG. 1 is an isometric view showing a container according to the present invention including the top, rear and one side.
Figure 2:
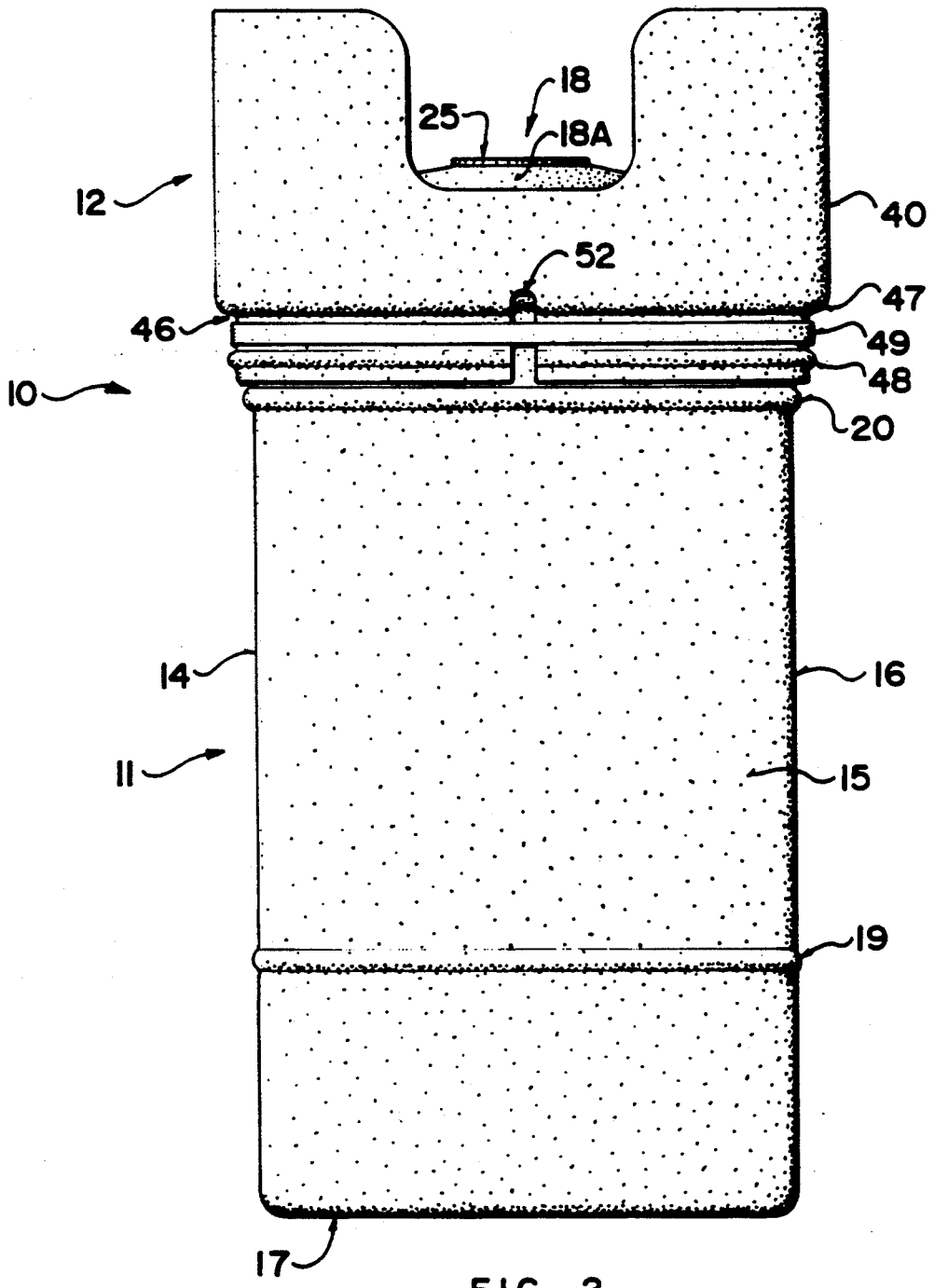
FIG. 2 is a front elevational view of the container of FIG. 1.
Figure 3:
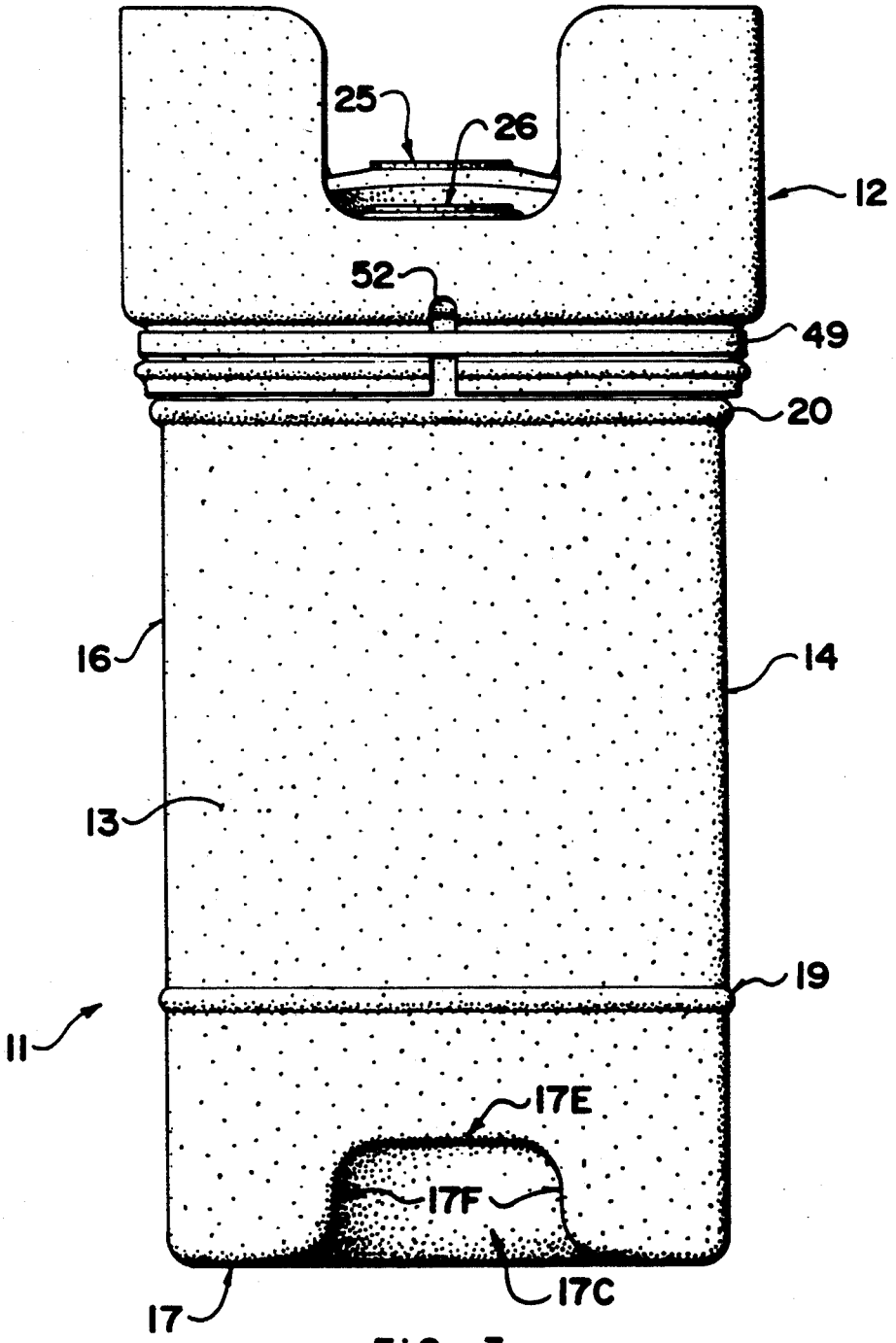
FIG. 3 is an elevational view of the container of FIG. 1.
Figure 4:
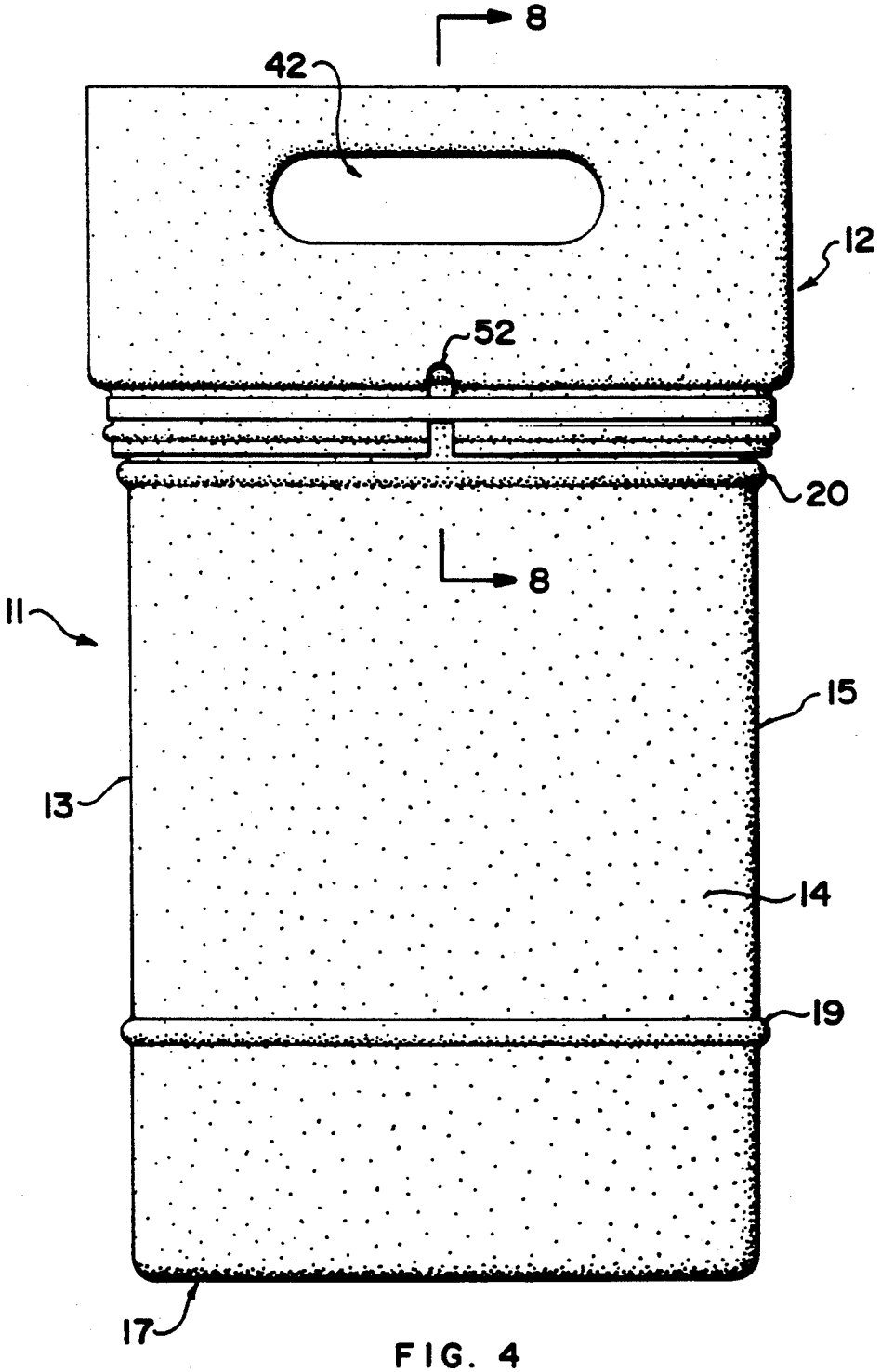
FIG. 4 is a side elevational view of the container of FIG. 1.
Figure 5:
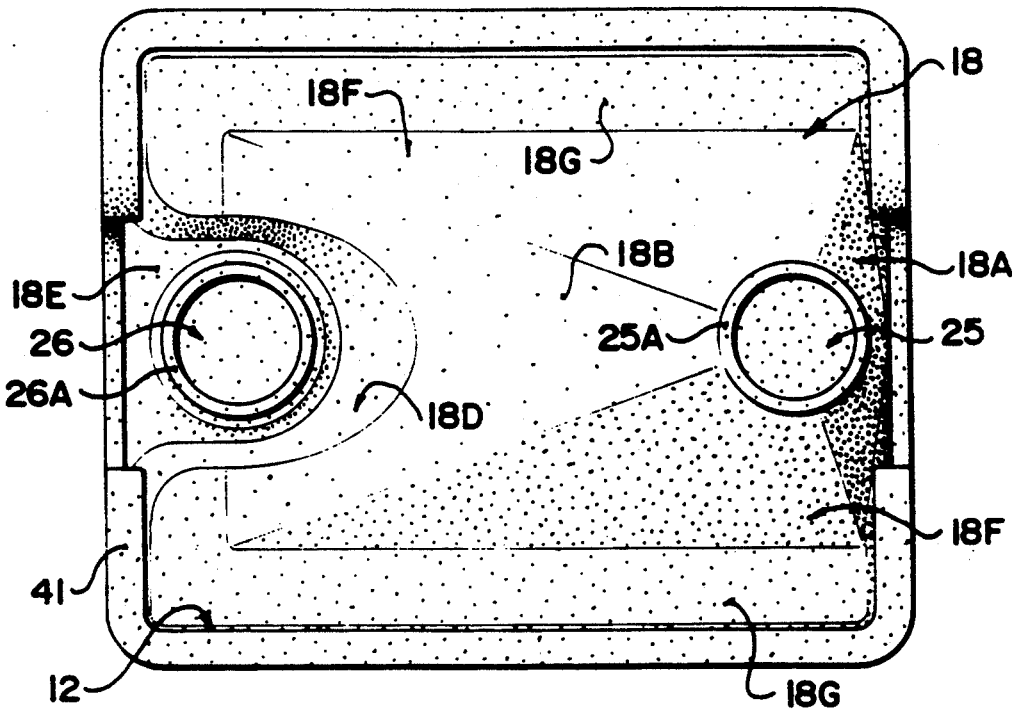
FIG. 5 is a top plan view of the container of FIG. 1.
Figure 6:
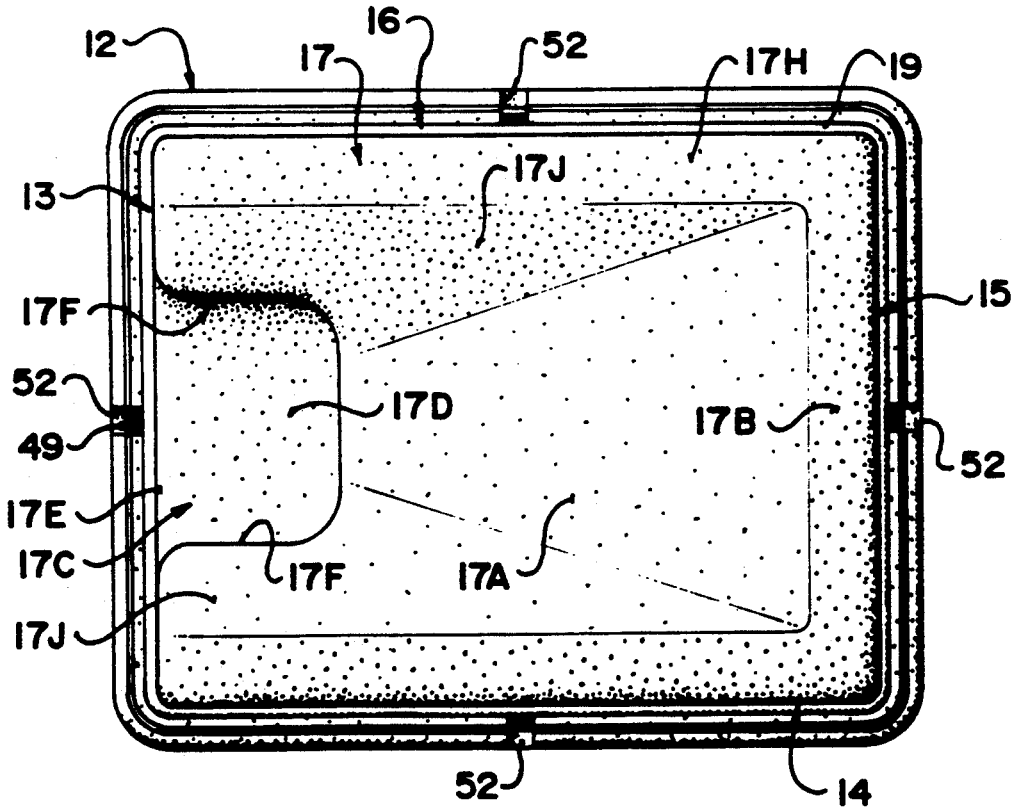
FIG. 6 is a bottom plan view of the container of FIG. 1.

As best shown in FIG. 1, the opening 25 is formed in a planar horizontal portion 18A of the top wall 18. A second substantially planar portion 18B is inclined downwardly from the uppermost portion 18A toward the opposed side wall 13 so that the height of the top wall at the side wall 13 is lower than the height of this top wall at the side wall 15. The opening 26 is formed within a recess portion 18C of the top wall, the recess being defined by a relatively sharply inclined section 18D surrounding a substantially planar portion 18E within which the opening 26 is formed. Thus the uppermost edge 26B of the cylindrical wall portion 26A is located beneath the plane of the inclined portion 18B by a distance sufficient to allow the insertion of a closure member of the type which can be screwed into the female screw thread 27. Thus the whole of the opening 26 and its closure member (not shown) are received beneath the plane of the inclined surface 18B so as to be free from projection above that plane. The top wall also includes two side inclined portions 18F which incline downwardly and sidewardly from the portions 18A and 18B toward a band 18G which extends along the three sides 13, 14 and 16.

The bottom wall 17 is generally shaped so that a second similar container when rotated through 180 degrees relative to the container shown can be stacked on top of the upper wall 18 of the container shown. Thus the bottom wall 17 includes an inclined planar portion 17A which is inclined relative to a horizontal bottom edge 30 of the side walls 14 and 16. The inclined bottom wall portion 17A inclines upwardly from a point 17B on a lowermost band 17H extending along the sides 13, 15 and 16. The point 17B is arranged adjacent the side 15 at a location directly underneath the opening 25. The bottom wall further includes side inclined portion 17J extending from the inclined portion 17A toward the band 17H. The inclination angle of the inclined wall portion 17A is the same inclination angle as the wall portions 18B and the portion 17J match the portion 18G so that in the stacked condition these wall portions can lie in contact while the central axis of the containers lie parallel and vertical. In addition the inclination of the wall portions 17A and 17J cause remaining liquid in the container to drain toward the band 17H and particularly the location 17B. From this location the liquid can be withdrawn to substantially wholly drain the container by a vertical drain tube inserted through the opening 25 and extending along the inside surface of the side wall 15 to the location 17B.

A recess wall portion 17D is arranged on the bottom wall 17 to extend from a position at an edge of the inclined portion 17A remote from the side wall 15 upwardly and then in a horizontal direction to intersect with the side wall 13 at an interconnecting line 17E. The width of the recess is approximately one third of the width of the side wall so that the recess has sides 17F which extend downwardly to intersect and join integrally the wall portions 17J on either side of the recess 17D. The recess is shaped and arranged so as to receive the closure member 29 of the next underlying similar container in the stacked condition.

The upper flange portion 12 comprises a separate moulded body forming a sleeve with two open ends so the lower part of the sleeve can be engaged over the upper part of the container to hold the sleeve in place with an upper part of the sleeve projecting beyond the top wall. The sleeve is rectangular in plan view to follow the periphery of the top of the container.

As best shown in FIG. 8, the sleeve has a vertical side wall 40 with an upper flange 41 turned at right angles inwardly of the vertical wall to provide strength for the upper edge. Within the side wall is formed a handle opening 42 which includes a peripherally extending flange 43 surrounding the opening 42 and again projecting inwardly to the same extent as the flange 41. Apart from the flanges 41 and 43, the wall portion 40 is substantially vertical and plane and extends downwardly beyond the top wall 18 to a position just beneath the shoulder 23 defined at the bottom of the band 21.

At the bottom of the portion 40, the sleeve includes a lower portion 45 which again is substantially vertical but is recessed inwardly from the portion 40 by a wall portion 46 so that it lies parallel to the portion 40 but recessed inwardly therefrom by a distance equal to the height of the shoulder 23. Thus the portion 45 lies in contact with the main part of the side wall 14 as shown in FIG. 8 and is located at a predetermined height thereon by the presence of the shoulder 23 and by the rib 20 which prevents the portion 45 from sliding downwardly along the side wall 14. The recess portion 46 also defines a shoulder 47 on the outside surface of the portion 45. A rib 48 is provided just above the bottom edge of the portion 45 thus forming a channel for receiving a strapping band 49 wrapped around the portion 45 and clamping that portion in place. The sleeve includes one or more notches 52 cut vertically from the bottom edge of the portion 45 to a portion partway up the portion 40.

Thus in assembly, the sleeve is forced over the band 21 by the slight deformation and expansion available from the plastic material from which the sleeve is moulded and from the notches 52. The sleeve then contracts into place as shown in FIG. 8 so that the portion 45 is held between the shoulder 23 and the rib 20. The steel band 49 is then attached and tightened into place to clamp the portion 45 against the side walls of the container. The notches 52 allow the portion 45 to be slightly compressed in a circumferential direction by the action of the band 49 to obtain a more effective clamping action necessary to locate the portion 46 against the shoulder 23 when vigorous lifting loads are applied to the container.

The construction of the container as shown has the following advantages:

1. It is possible to obtain 100 percent draining of the contents in a dispensing of the contents through the opening 25 by an inversion of the container since the opening 25 is arranged immediately adjacent the side wall 15 with the portion 15A defining an edge of the opening and the outside surface of the wall 15. There is no recess between the opening and side wall into which the liquid can collect.

2. The location of the opening 25 in relation to the inclined lower wall 17 ensures again substantially complete drainage when using a dip tube or suction tube.

3. The cooperating shape of the top and bottom walls provides the drainage mentioned above and at the same time allows the opening to be properly recessed to obtain the stacking effect described above.

4. The sleeve arrangement separately attached to the container provides an effective handle/lifting device which can be simply manufactured and attached to the container by the strap and interlocking channel arrangement.

5. The stacking can be obtained simply by the side walls sliding inside the inside surface of the sleeve due to the presence of the upper band 21 which ensures that the sleeve is carried at a position spaced slightly outwardly from the side walls of the container itself.

6. The sides and shape configuration of the containers are arranged such that nine containers can be stacked on a conventional 48 inch×42 inch pallot. For this purpose the maximum width of the container and particularly the upper flange portion of the container is of a width of 16 inches across the side walls 14 and 16 and a width of 14 inches across the side walls 13 and 15. For a container having a volume of 55 liters, with dimensions of this order requires a height of the order of 20 inches which provides a suitable stable structure which can be readily handled, lifted and stacked.

Since various modifications can be made in my invention as hereinabove described, and many apparently widely different embodiments of same made within the spirit and scope, it is intended that all matter contained in the accompanying specification shall be interpreted as illustrative only and not in a limiting sense.

I claim:

1. A liquid transportation container comprising a moulded hollow substantially closed container body having a generally horizontal base wall, upstanding side wall means and a generally horizontal top wall, first opening means in the top wall for discharge of liquid contents from the container, the first opening means being arranged in the top wall at a position adjacent one portion of the side wall means and remote from an opposed portion of the side wall means, the base wall being inclined relative to the horizontal such that a first location on the base wall directly vertically below the opposed portion of the side wall means is raised above a second location on the base on the base wall directly vertically below the first opening means so as to cause liquid at the base wall to run down to and collect at the second location, the top wall being inclined relative to the horizontal such that the first opening is raised above a second location on the top of wall adjacent said opposed portion of the side wall means, whereby a second similar container can be stacked underneath the container when rotated about a vertical central axis through 180 degrees.

2. The container according to claim 1 wherein an undersurface of the bottom wall has a recess projecting into the hollow container body at said first location for receiving therein a closure member for the first opening of the second similar container.

3. The container according to claim 1 including second opening means at the second location on the top wall.

4. The container according to claim 3 wherein the top wall is gradually inclined downwardly from the first location towards the second location and wherein the second location is defined within a recess projecting downwardly from the top wall into the hollow container such that the second opening is received within said recess.

5. The container according to claim 1 wherein the first opening means is arranged immediately adjacent said one portion of the side wall means and wherein said second location on the base wall is arranged immediately adjacent said side wall means.

6. The container according to claim 5 wherein the first opening means comprises a substantially cylindrical wall having a substantially vertical longitudinal axis and a female screw thread on the inside surface of the wall for receiving a male threaded closure member in engagement with the female screw thread, the cylindrical wall being arranged immediately adjacent one portion of the side wall means such that an outside surface of the cylindrical wall at said one portion constitutes an outside surface of the side wall means.

7. The container according to claim 5 wherein the side wall means extends in a substantially straight vertical line from said second location on the base wall to said first opening means.

8. The container according to claim 1 wherein there is provided an upper flange member attached to the container body so as to extend upwardly form the side wall means to a height above the top wall, the upper flange member extending around the full periphery of the container body and including means therein defining handle holes by which the flange member can be grasped for lifting of the container body, the upper flange member including a depending flange portion surrounding and lying in contact with an upper portion of the side wall means, the upper portion including outwardly projecting shoulder means for abutting the depending flange portion and locating the depending flange portion against vertical movement relative to the upper portion and securing band means wrapped around the depending flange portion to camp the depending flange portion on to the upper portion of the side wall means.

9. The container according to claim 8 wherein the side wall means includes a surrounding band thereof adjacent the top wall which projects outwardly form a main portion of the side wall means and wherein the depending flange portion includes a first portion arranged to lie alongside the band and a second portion below the first portion arranged inwardly of the first portion so as to engage under the band, said shoulder means being provided on an underside of said band.

10. The container according to claim 9 wherein the upper portion of the side wall means includes a second shoulder means below the band and arranged such that said second portion of the depending flange portion is located between the second shoulder means and the underside of the band.

11. The container according to claim 9 wherein the second portion of the depending flange portion includes means defining a shoulder thereon at a position spaced downwardly of the first portion thereof so as to confine said securing band means therebetween.

12. The container according to claim 8 wherein the securing band means comprises a metal strap wrapped fully around the periphery of the side wall means.

* * * * *